US007121506B2

(12) United States Patent
Clancy

(10) Patent No.: US 7,121,506 B2
(45) Date of Patent: Oct. 17, 2006

(54) REMOTELY CONTROLLED MODEL AIRPLANE HAVING DEFLECTABLE CENTRALLY BIASED CONTROL SURFACE

(76) Inventor: Andy J. Clancy, 1116 N. Westwood, Mesa, AZ (US) 85021

( * ) Notice: Subject to any disclaimer, the term of this patent is extended or adjusted under 35 U.S.C. 154(b) by 0 days.

(21) Appl. No.: 11/009,606

(22) Filed: Dec. 10, 2004

(65) Prior Publication Data

US 2006/0144995 A1 Jul. 6, 2006

(51) Int. Cl.
*B64C 13/02* (2006.01)

(52) U.S. Cl. ..... 244/99.2; 244/190; 446/87; 335/230

(58) Field of Classification Search ..... 244/131, 244/75.1, 189, 190, 99.2; 441/57–58; 335/230, 335/272

See application file for complete search history.

(56) References Cited

U.S. PATENT DOCUMENTS

| | | | | | |
|---|---|---|---|---|---|
| 2,771,572 | A | * | 11/1956 | Adams | 335/230 |
| 3,087,257 | A | * | 4/1963 | White | 434/15 |
| 3,152,290 | A | * | 10/1964 | Cassano et al. | 335/272 |
| 3,304,526 | A | * | 2/1967 | Adams | 335/230 |
| 3,355,838 | A | * | 12/1967 | Huffman | 446/57 |
| 3,558,081 | A | | 1/1971 | Williams | 244/17.19 |
| 3,645,481 | A | * | 2/1972 | Purdy | 244/123.5 |
| 3,699,708 | A | | 10/1972 | Mabuchi | 46/243 |
| 3,721,405 | A | | 3/1973 | Jackson | 224/17.21 |
| 3,755,963 | A | * | 9/1973 | Mabuchi | 446/57 |
| 3,799,358 | A | | 3/1974 | Putnam | 212/59 |
| 3,803,758 | A | * | 4/1974 | Chang et al. | 446/58 |
| 3,957,230 | A | | 5/1976 | Boucher et al. | 244/53 |
| 4,648,345 | A | * | 3/1987 | Wham et al. | 114/338 |
| 4,729,750 | A | | 3/1988 | Prusman | 446/225 |
| 4,809,931 | A | | 3/1989 | Mouille et al. | 244/17.21 |
| 5,035,382 | A | | 7/1991 | Lissaman et al. | 244/190 |
| 5,087,000 | A | | 2/1992 | Suto | 244/189 |
| 5,108,044 | A | | 4/1992 | Weiner et al. | 244/17.19 |
| 5,131,604 | A | | 7/1992 | Yoerkie et al. | 244/17.19 |
| 5,738,301 | A | | 4/1998 | Francois et al. | 244/17.19 |
| 5,971,320 | A | | 10/1999 | Jermyn et al. | 244/17.25 |

(Continued)

OTHER PUBLICATIONS

Jim Lewis, "R/C Micro electric Plane", emachineshop.com Copyrighted 2003.*

(Continued)

*Primary Examiner*—Galen Barefoot
(74) *Attorney, Agent, or Firm*—Cahill, von Hellens & Glazer P.L.C.

(57) ABSTRACT

A remotely controlled model airplane includes a receiver responsive to signals from a transmitter to control the direction of flight of the model airplane. The receiver, powered by a battery, demodulates the signal transmitted by the transmitter to selectively energize an electrical coil to generate a magnetic field of a first or second polarity. A rudder pivotally attached to the vertical stabilizer includes a magnet responsive to the magnetic fields generated and is urged in one direction or the other resulting in commensurate pivotal movement of the rudder. A hinge interconnecting the rudder and vertical stabilizer urges return to center of the rudder after it has been deflected left or right by the magnet responding to the magnetic field created as a result of a signal transmitted by the transmitter. An electric motor also under control of the transmitter and receiver may be incorporated to rotate a propeller to provide thrust and forward motion of the model airplane. By employing a transmitter to selectively transmit a plurality of signals, control surfaces of the model airplane can be deflected to provide 2-axis control to selectively alter the direction and pitch of the model airplane.

34 Claims, 3 Drawing Sheets

U.S. PATENT DOCUMENTS

| | | | | |
|---|---|---|---|---|
| 6,374,519 | B1 | 4/2002 | Beaumont | 37/307 |
| 6,382,556 | B1 | 5/2002 | Pham | 244/6 |
| 6,520,823 | B1 * | 2/2003 | Tian et al. | 446/57 |
| 6,520,824 | B1 | 2/2003 | Caroselli | 446/58 |
| 6,582,154 | B1 | 6/2003 | Updyke | 404/118 |
| 6,659,395 | B1 | 12/2003 | Rehkemper et al. | 244/17.11 |
| 6,739,942 | B1 | 5/2004 | Tian et al. | 446/454 |
| 6,783,096 | B1 | 8/2004 | Baldwin | 244/12.4 |
| 2002/0100839 | A1 * | 8/2002 | Miller et al. | 244/131 |

OTHER PUBLICATIONS 2.007 Kit Part: Rubber BANDS, Possible uses of rubber bands, officedepot.com Jan. 9, 2006.*

* cited by examiner

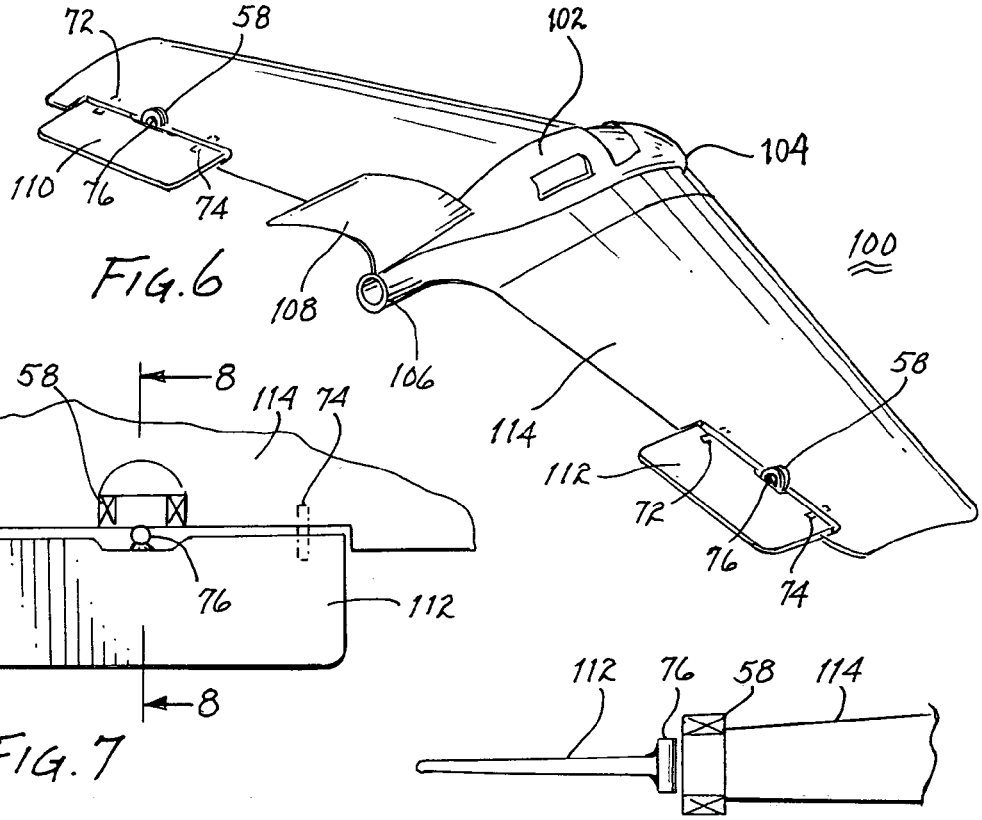
FIG. 6
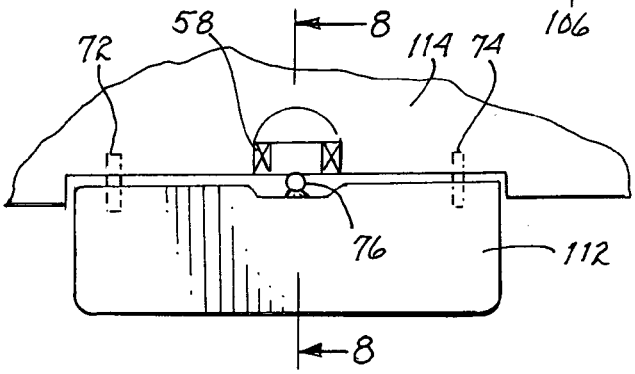
FIG. 7
FIG. 8
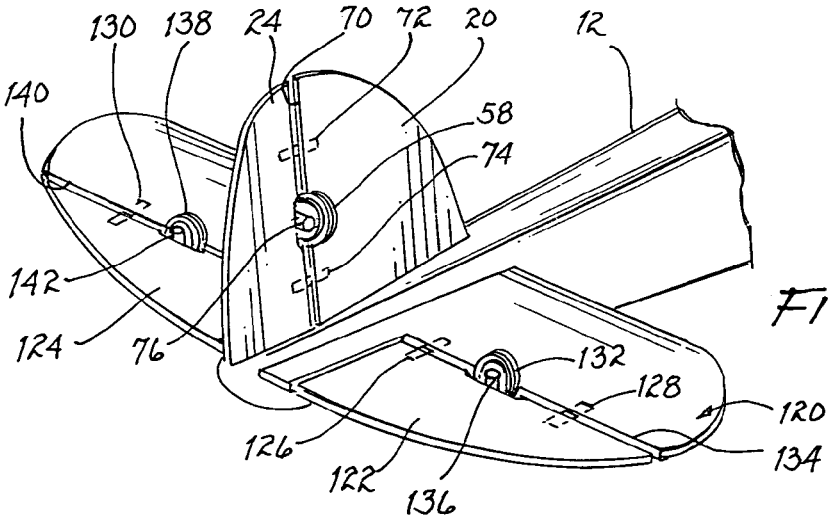
FIG. 9

REMOTELY CONTROLLED MODEL AIRPLANE HAVING DEFLECTABLE CENTRALLY BIASED CONTROL SURFACE

BACKGROUND OF THE INVENTION

1. Field of the Invention

The present invention relates to control systems for remotely controlled model airplanes and, more particularly, to magnetically operated centrally biased control surfaces for a model airplane.

2. Description of Related Prior Art

Remotely controlled, and formerly referred to as radio controlled, model airplanes have been built and flown as a hobby since the 1940s when vacuum tube operated transmitters and receivers became available for use in model airplanes. With advances in the transmitter/receiver art, there have been significant size and weight reductions in the related equipment and there have been significant improvements in reducing the electrical power requirements. With such reductions in size and weight, smaller and lighter model airplanes became possible to be remotely controlled.

Initially, the control system actuated by a signal from the receiver was a rubber band driven escapement that provided left or right rudder deflection for directional control. Generally, such escapements lacked sufficient power to deflect the elevator to obtain a change in pitch or to deflect the ailerons to obtain a left or right rolling moment about the longitudinal axis. Moreover, control of the engine speed and operation was primarily limited to shutting down the engine, which engine was usually a single cylinder internal combustion engine. As technology advanced, several servo mechanisms were developed which had significant power to operate the various control surfaces and to provide a throttling capability for the engine. During the last ten years or so, the size of these servos has been significantly reduced. They also became capable of full proportional control to accurately deflect the respective control surface(s).

Through careful aerodynamic design of a model airplane, it is possible to control not only the direction of flight but also the pitch attitude of a model airplane using only deflection of the rudder. A skilled pilot can even do basic aerobatic maneuvers using only selected timed rudder deflection. For small sized lightweight model airplanes, a magnetic actuator for the rudder was available a number of years ago. This actuator included a coil to drive a linkage connected to the rudder of the model airplane. The signal transmitted by the transmitter and received by the receiver either energized the coil or de-energized the coil. The rudder was biased in one direction during the absence of a signal and upon transmission of a control signal, the coil was energized to cause deflection of the rudder in the other direction. By regulating the relative on/off periods of energizing the coil, directional control of the airplane could be maintained but a great deal of skill by the ground based pilot was required. Because of the low power output of the coil, the linkage connected to the rudder had to be very carefully adjusted, be essentially slop free and minimal friction was required.

With the advent of micro sized receivers, electric motors and small powerful batteries, small and light weight model airplanes can now be remotely controlled. As small and light weight model airplanes require relatively small forces to actuate control surfaces for controlling movement in the pitch, yaw and longitudinal axis, new and innovative low power servo mechanisms can be used for these purposes.

SUMMARY OF THE INVENTION

A conventionally configured model airplane that has a fuselage supporting a wing for generating lift, a fixed horizontal stabilizer for providing stability in the pitch axis and a vertical stabilizer for providing stability in the yaw axis includes a pivotally mounted rudder biased to the center position. A motor driven propeller for providing thrust may be included. A ground based transmitter includes a control to regulate left and right deflection of the rudder and may include a further control for the airplane motor to regulate the thrust. By such deflection of the rudder, the direction of travel of the model airplane can be controlled. A coil fixedly attached to the vertical stabilizer adjacent the hinge line with the rudder is energized to provide a magnetic field having a first or second polarity. A magnet attached to the rudder proximate the coil is responsive to each magnetic field generated and as a result of such response is urged to pivot to the left or the right. In response to the movement of the magnet, the rudder will be deflected left or right and the model airplane will change direction accordingly. On cessation of a signal actuating the coil, the hinges interconnecting the rudder with the vertical stabilizer bias the rudder to the center position. Thereby, the control signals generated by the transmitter and received by the receiver to actuate the coil provide left or right deflection of the rudder and a mechanical hinge automatically returns the rudder to the central position.

If the transmitter and receiver are appropriately configured, 2-axis control of the model airplane is possible. To implement such 2-axis control, the horizontal stabilizer includes an elevator actuated by the above described coil and magnet. For a model airplane having a V-tail, each of the control surfaces is actuated by such a coil and magnet to provide control in the yaw axis and the pitch axis. A flying wing may include elevons each of which is actuated by the same type of coil and magnet to provide control about the pitch axis and about the longitudinal axis.

It is therefore a primary object of the present invention to provide a lightweight control system for controlling the flight of a remotely controlled model airplane.

Another object of the present invention is to provide a selectively actuated coil for deflecting a control surface of a model airplane in one direction or the other.

Still another object of the present invention is to provide a rudder for a model airplane that is biased to the central position and deflectable left or right in response to a created magnetic field.

Yet another object of this invention is to provide a magnet mounted on a control surface of a model airplane responsive to a selectively actuated coil for controlling the direction of flight of the model airplane.

A further object of the present invention is to provide flexible hinges for a control surface of a model airplane to bias the control surface to the central position and yet accommodate movement of the control surface about the hinge line in response to a magnetic field acting upon a magnet secured to the control surface.

A still further object of the present invention is to provide a low cost operating system for selectively deflecting one or more control surfaces of a model airplane.

A yet further object of the present invention is to provide a magnetically actuated rudder for a model airplane.

A yet further object of the present invention is to provide a magnetically actuated elevator for a model airplane.

A yet further object of the present invention is to provide magnetically actuated control surfaces of a V-tail model airplane.

A yet further object of the present invention is to provide magnetically actuated elevons of a flying wing model airplane.

A yet further object of the present invention is to provide a method for magnetically controlling the deflection of a control surface of a model airplane.

These and other objects of the present invention will become apparent to those skilled in the art and the description there proceeds.

BRIEF DESCRIPTION OF THE DRAWINGS

The present invention will be described with greater specificity and clarity with reference to the following drawings, in which:

FIG. 6 illustrates a flying wing having elevons as control surfaces;

FIG. 7 is a detail view of an elevon, illustrating a coil and a magnet for actuating the elevon;

FIG. 8 is a cross section taken along lines 8—8, as shown in FIG. 7;

FIG. 9 illustrates a conventional horizontal stabilizer with elevators and a vertical stabilizer with rudder forming the rear empennage of a model airplane;

DESCRIPTION OF THE PREFERRED EMBODIMENT

Figure 1A:
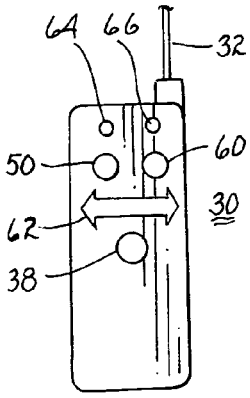
FIG. 1A is a representative view of a transmitter for transmitting control signals to the model airplane shown in FIG. 1.
Figure 1:
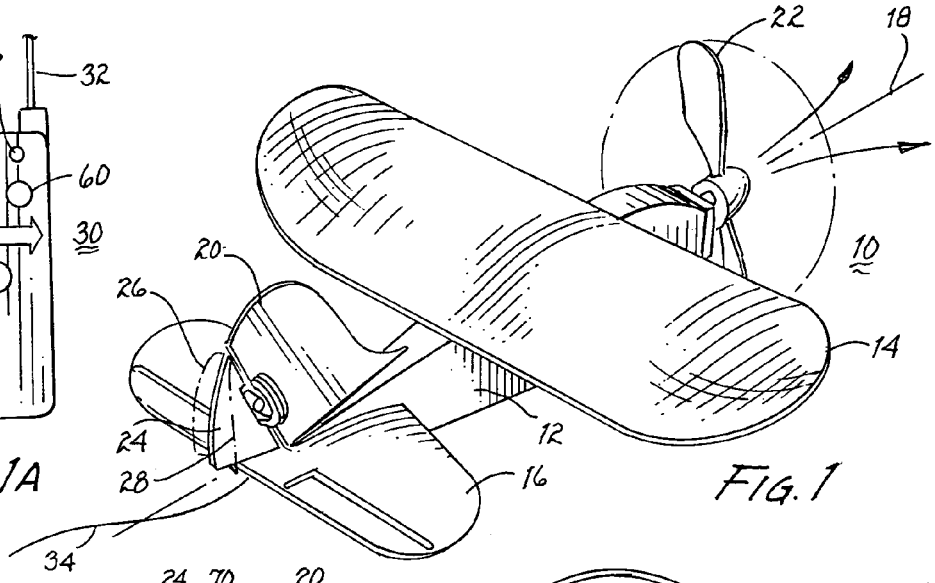
FIG. 1 is an isometric view of a remotely controlled model airplane incorporating the present invention.

Referring to FIG. 1, there is shown a model airplane 10. The airplane includes a fuselage 12 supporting a wing 14 for generating lift upon forward motion of the plane. A horizontal stabilizer 16 provides stability in the pitch axis and is generally in alignment with longitudinal axis 18. However, for stability purposes, the horizontal stabilizer may have a small negative angle of attack. A vertical stabilizer 20 provides stability about the yaw axis of the model airplane. A propeller 22 is turned by a motor (see FIG. 2) mounted within fuselage 12 and provides thrust for forward motion of the model airplane. A rudder 24 is hingedly attached to vertical stabilizer 20 and upon movement left or right, as depicted by dashed lines 26, 28, the direction of flight of the airplane will change to the left or to the right, respectively.

Figure 2:
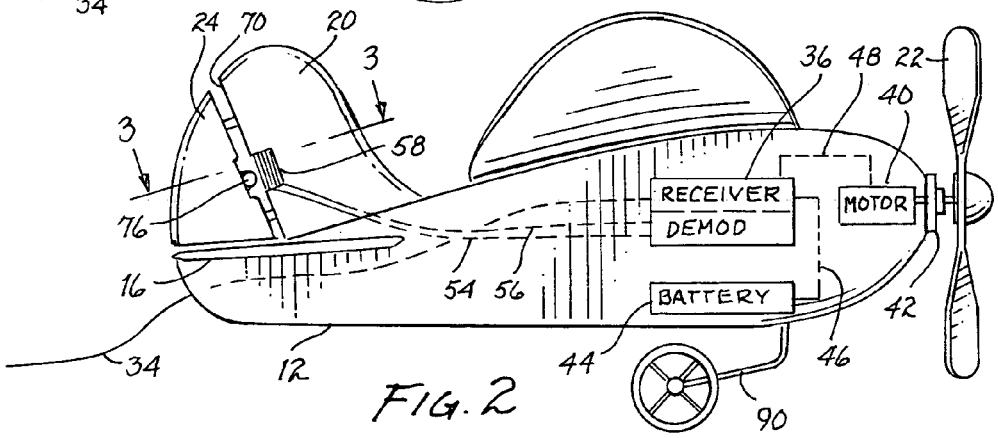
FIG. 2 is a side view of the model airplane.
Figure 4:
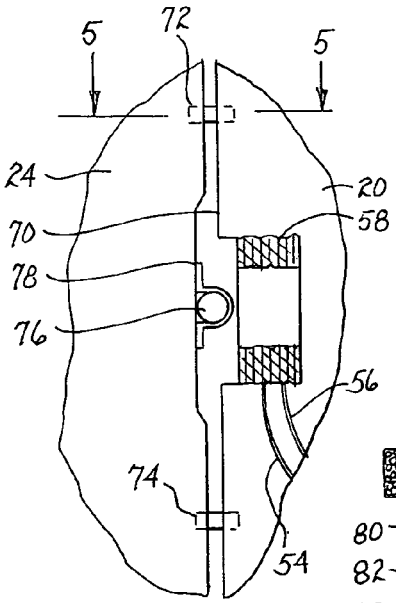
FIG. 4 is a partial side view of the interconnection between the vertical stabilizer and the rudder.
Figure 5:
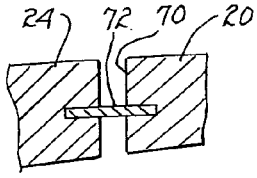
FIG. 5 is a cross sectional view taken along lines 5—5, as shown in FIG. 4.

Model airplane 10 is remotely controlled, sometimes referred to as radio controlled. Referring jointly to FIGS. 1, 1A and 2, the remote control apparatus will be described. A transmitter 30 includes an antenna for radiating the transmitted signal. The transmitted signal is sensed by antenna 34 electrically connected to receiver 36 mounted within fuselage 12. The transmitter includes several controls. A button 38, or the like, on transmitter 30 provides an on/off function for motor 40 located in the nose of model airplane 10. Typically, a gear box 42 interconnects the armature of motor 40 with propeller 22. Also typically, electrical power to the motor is provided by battery 44 through electrical conductors 46 connected with the circuitry in receiver 36 and through electrical conductor 48 providing power to motor 40 upon actuation of button 38 in the transmitter. Thereby, transmitter 30 controls the thrust produced by propeller 22.

When button 50 on transmitter 30 is depressed, a signal for a left turn is generated and transmitted. This signal is sensed by receiver 36 through antenna 34 and suitably demodulated by demodulator 52, which demodulator may be a part of the circuitry of the receiver. The demodulator produces a control signal via electrical conductors 54, 56 to energize coil 58. Upon applying electrical power to the coil, it will produce a magnetic field of a first polarity. Control of the magnetic polarity is a function of which of conductors 54, 56 conveys a greater positive voltage to the coil. Upon depressing button 60 on transmitter 30, a further signal is transmitted via antenna 32 and sensed by receiver 36 through antenna 34. Demodulator 52 demodulates this signal and produces a further control signal on electrical conductors 54, 56. This further control signal is of the reverse polarity of the control signal on conductors 54, 56 when button 50 is depressed. Thus, the magnetic field produced by coil 58 is now reversed in polarity. As depicted by arrow 62 on transmitter 30, button 50 corresponds with a left turn and button 60 corresponds with a right turn.

Additional indicators 64, 66 may be employed in the transmitter to indicate the voltage state of the circuitry driving the transmitter, the state of charge in the event battery 44 is charged by the transmitter upon moving the battery from the model airplane to a compartment within the transmitter. Other indicia for various purposes may also be incorporated.

Referring jointly to FIGS. 2, 3, 3A, 4 and 5, details attendant the attachment of rudder 24 to vertical stabilizer 20 and operation of the rudder will be described. Coil 58 is mounted in vertical stabilizer 20 close to hinge line 70, representatively shown as the trailing edge of the vertical stabilizer. Electrical conductors 54, 56 provide power to the coil and produce the above described magnetic field having a first or a second polarity. Rudder 24 is attached to the vertical stabilizer by a pair of segments of rubber bands 72, 74. Typically, the end of each rubber band is inserted and glued within a slot at hinge line 70 of the vertical stabilizer 20 and similarly lodged and glued within corresponding slots in rudder 24. As illustrated, a space exists between the rudder and the vertical stabilizer. The purpose of this space is to permit the rudder to deflect left and right relative to the vertical stabilizer without binding or otherwise contacting the hinge line or other part of the vertical stabilizer during the normal extension of rudder deflection left and right. A magnet 76 is secured to the leading edge of rudder 24 by a dab of glue, a strap 78, as shown, or other device.

Figure 3A:
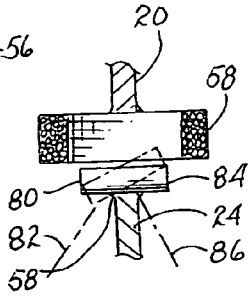
FIG. 3A is a further detailed view of the coil and magnet.
Figure 3:
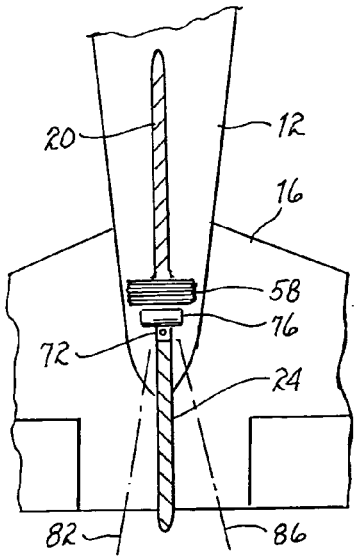
FIG. 3 is a top view of a coil mounted on the vertical stabilizer and a magnet mounted on the rudder of a model airplane and taken along lines 3—3, as shown in FIG. 2.

Upon energizing coil 58 by pushing button 50 on transmitter 30, the coil will create a magnetic field to attract the left side of magnet 76, hereinafter referred to as pole 80. In response to such magnetic attraction, pole 80 will be drawn toward and move toward coil 58. The resulting movement of the magnet will cause the rudder to deflect to the left, as shown in FIG. 3A and represented by dashed line 82. With the rudder moved to the left, model airplane 10 will go into a left turn. Once button 50 is released, no further power is applied to coil 58. Without such power, magnet 76 is no longer attracted to the coil. The resiliency of rubber bands 72, 74 will therefore urge the rudder to its central position, as depicted in FIG. 3, 3A which essentially aligns the rudder with the vertical stabilizer. With such alignment, model airplane 10 will travel essentially straight ahead. Upon depressing button 60 of transmitter 30, a further control signal will be generated and conveyed to coil 58 through electrical conductors 54, 56. This further control signal is of opposite polarity, as discussed above, and the magnetic field produced by the coil is of opposite polarity also. As a result, pole 84 of magnet 76 will be attracted to the coil. Such attraction will result in commensurate movement of the magnet and rudder 24 coupled with the magnet. The extent of movement is represented by dashed line 86. With the rudder in this position, model airplane 10 will turn to the right. On release of button 60, the magnetic field generated by coil 58 will cease and neither pole 80 or 84 of magnet 76 will be attracted to the coil. Hence, rudder 24 will once again will become essentially aligned with vertical stabilizer 20 in response to urging by rubber bands 72, 74. As a result, the model airplane will once again fly straight ahead.

As illustrated in FIG. 2, the model airplane may include an undercarriage 90 to permit taxiing on a surface and to take off along a simulated runway. Similarly, the undercarriage will permit landing on a smooth surface in the manner of a conventional airplane. During such taxiing and take off, buttons 50 and 60 on transmitter 30 may be actuated to control the direction of movement of the model airplane during both taxiing and take off.

Referring to FIG. 6, there is illustrated a representative flying wing 100. A model airplane of this type generally includes a center section 102, sometimes referred to as a fuselage, for housing a remote control receiver and batteries. Although not shown, a motor driving a propeller may be mounted in nose 104 of the center section to provide thrust. Alternatively, such a motor and propeller may be mounted at tail 106. Usually, one or more rudders 108 are provided for directional stability. Control of flying wing 100 about the pitch axis and the longitudinal axis is obtained by operation of elevons 110, 112. When these elevons operate in concert, either up or down, the pitch attitude of the flying wing is changed. When these elevons operate in the opposite directions, that is, one elevon is deflected upwardly and the other elevon is deflected downwardly, forces are generated to cause the flying wing to rotate about its longitudinal axis. Such rotation results in the lift produced by the flying wing to be toward the inside of the bank and result in turning of the flying wing.

The structure and operation of the elevons will be described with specific reference to FIGS. 6, 7 and 8. Elevon 12 is pivotally attached to wing 114 by two or more segments of rubber bands 72, 74, as described above. These segments of rubber bands will tend to bias the elevon in its neutral or central position. A coil 58 is mounted in wing 14 adjacent the hinge line between the wing and elevon 112. This coil is of the type described above. A magnet 76 is attached to the leading edge of elevon 112 proximate coil 58. As described above, energization of coil 58 with a first polarity will attract one pole of magnet 76 and result in commensurate movement of elevon 112. When the polarity of the signal applied to coil 58 is reversed, the other pole of magnet 76 will be attracted and elevon 112 will be deflected in the opposite direction. As also described, a remote control receiver is mounted at an appropriate location within flying wing 100 to generate signals to coil 58 in response to signals transmitted from a transmitter.

Elevon 110 is similarly attached to wing 114 by segments of rubber bands 72, 74 and is actuated by a similar coil 58 selectively energized to attract magnet 76 to produce upward or downward deflection of the elevon. Elevons 110 and 112 may be deflected in concert upwardly or downwardly to produce a change in pitch attitude of the flying wing. Alternatively, they may be deflected in opposite directions to provide a left or right rolling movement about the longitudinal axis of the flying wing.

Referring to FIG. 9, there is illustrated the rear section of fuselage 12, which may be part of the model plane shown in FIGS. 1 and 2. For this reason, common elements will be assigned corresponding reference numerals. Rudder 24 is pivotally attached to vertical stabilizer 20 through segments of rubber band 72, 74. Upon actuation of coil 58, a magnetic force will be created and magnet 76 responds thereto resulting in deflection of rudder 24 in one direction or the other as a function of the signal generated by a receiver mounted in fuselage 12. Horizontal stabilizer 120 is attached to and supported by fuselage 12. A single or a pair of elevators are pivotally attached to the horizontal stabilizer and deflection thereof, whether up or down, will result in a change in the pitch attitude of the model airplane. It is to be noted that elevators 122, 124 work in concert, that is, upon command, both elevators deflect either upwardly or downwardly. Elevator 122 is pivotally secured to horizontal stabilizer 120 by a pair of segments of rubber bands 126, 128. These segments will bias the elevator into general alignment with the horizontal stabilizer and yet permit deflection in response to an imposed force. Similarly, elevator 124 is pivotally secured to the horizontal stabilizer by a pair of segments of rubber bands of which only rubber band 130 is illustrated. A coil 132 is mounted at hinge line 134 of horizontal stabilizer 120. Magnet 136 is mounted at the leading edge of elevator 122 proximate to and under the influence of a magnetic field generated by coil 132. Similarly, coil 138 is mounted proximate hinge line 140 of horizontal stabilizer 120. Magnet 142 is mounted at the leading edge of elevator 124 proximate to and under the influence of a magnetic field generated by coil 138. The function and operation of coil 132 and its magnet 136 and coil 138 and its magnet 142 are the same as that described above with respect to coil 58 and magnet 76. Accordingly, a repetition of such function and operation need not be undertaken.

Upon transmission of a signal from a transmitter, coil 58 is selectively actuated to deflect rudder 24 to the left or right, as described above. Upon transmission of a further signal from the transmitter, coils 132, 138 are energized to create a magnetic field of one polarity or the other. Magnets 136, 142 will respond to such magnetic field and cause deflection of elevators 122, 124 either up or down as a function of the polarity of the magnetic fields created. Such deflection of the elevators will result in a change in the pitch attitude of the model airplane.

Figure 10:
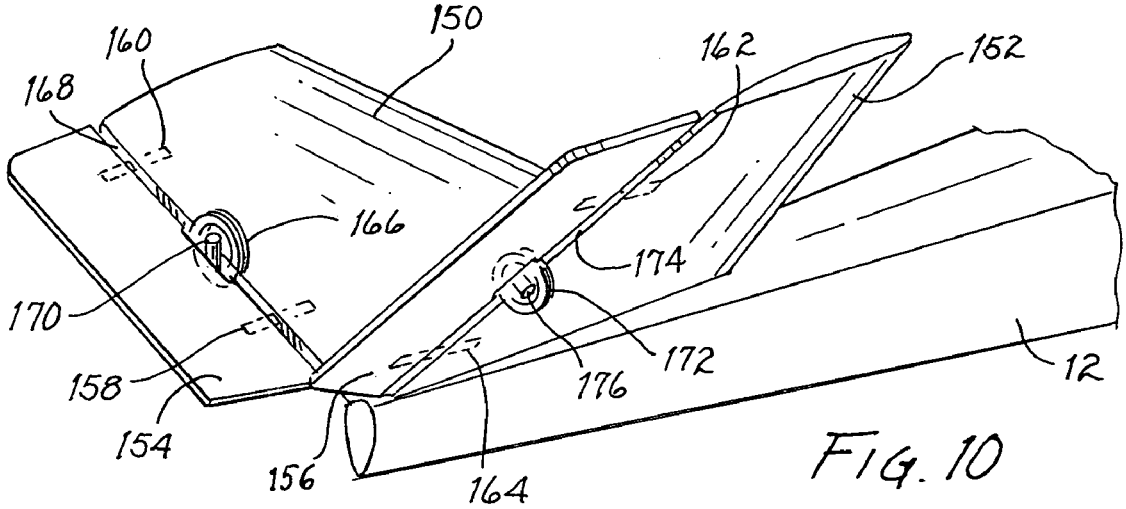
FIG. 10 illustrates a V-tail of a model airplane having control surfaces.

FIG. 10 illustrates the tail of a model airplane of which a part of fuselage 12 is illustrated. The rear empennage mounted on fuselage 12, as shown in FIG. 10, is generally referred to as a V-tail. It includes two fixed stabilizers 150, 152, each of which is set at an angle with respect to horizontal in the range of about 30–45°. Each of these stabilizers includes a pivotally connected control surface 154 and 156. Upon deflection of these control surfaces upwardly or downwardly, the pitch attitude of the model airplane will change to cause the airplane to climb or descend, respectively. Directional control is achieved by having the control surfaces deflect in opposite directions; that is, one control surface is deflected upwardly and the other one downwardly relative to the respective stabilizer. This will cause the model airplane to turn in the direction of the upwardly deflecting control surface. Thereby, control in the pitch and yaw axis will be achieved.

In the previous discussions of different model airplane configurations, the control surfaces have been identified as either rudder, elevator or elevon; however, the term control surface would apply equally well to any of such elements.

Control surface 154 is secured to stabilizer 150 by segments of rubber bands 158, 160 to bias the control surface in generally planar alignment with the stabilizer and yet accommodate deflection of the control surface. Similarly, control surface 156 is secured to stabilizer 152 by segments of rubber bands 162, 164 accomplishing the same function and purpose. A coil 166 is mounted proximate hinge line 168 of stabilizer 150. Magnet 170 is mounted at the leading edge of control surface 154 proximate coil 166 in order to be under the influence of a magnetic field created by the coil. Similarly, coil 172 is mounted proximate hinge line 174 of stabilizer 152. Magnet 176 is mounted at the leading edge in sufficient proximity to coil 172 to be under any magnetic field generated by the coil.

In response to a signal from a transmitter and received by a receiver in the model airplane depicted in FIG. 10, coils 166 and 172 will be energized to create a magnetic field of a first polarity resulting in movement of magnets 170, 176 that will cause control surfaces 154, 156 to be deflected upwardly. As noted above, such upward deflection will result in a change in pitch attitude of the model airplane. By transmitting a further signal to energize these coils to create a magnetic field of the opposite polarity, the resulting movement of magnets 170, 176 will result in downward deflection of control surfaces 154, 156. By transmitting a yet further signal to be received by the receiver in the model airplane, coil 166 will produce a magnetic field opposite in polarity to that of the magnetic field produced by coil 172. This will result in movement of magnet 170 and its control surface 154 in a direction opposite to that of control surface 156 due to the correspondingly opposite movement of magnet 176. Such movement of the control surfaces will result in a change in direction of the model airplane. By transmitting a yet further signal, the polarity of coils 166 and 172 will be reversed and result in opposite deflection of the respective control surfaces to achieve a change in direction of the model airplane in the opposite direction.

Figure 11:
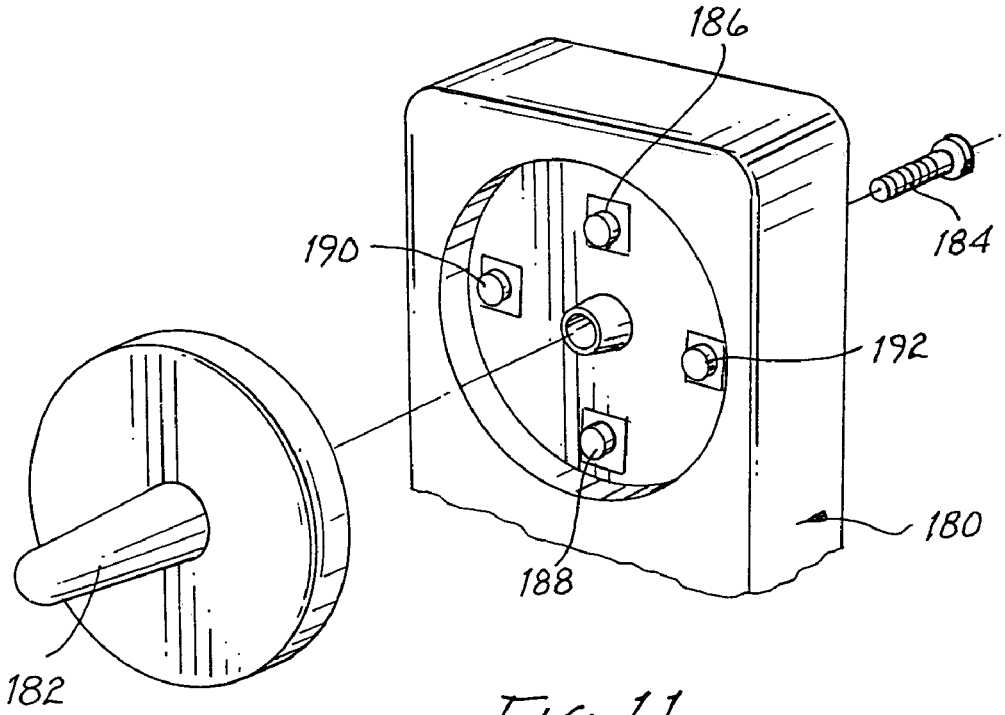
FIG. 11 illustrates a 2-axis transmitter for use with the model airplanes, as shown in FIGS. 6, 9 and 10.

Referring to FIG. 11, there is shown representatively a transmitter 180. This transmitter is similar to transmitter 30, shown in FIG. 1A, except that additional signals are selectively transmitted. A pivotally secured control stick 182 is pivotally attached to the transmitter by a screw or bolt 184. Upon up and down pivoting of the control stick, one of switches 186, 188 will be engaged. Upon such engagement, a signal will be transmitted to the receiver in the model airplane and the receiver will decode the signal to energize coils 166, 176 to cause either upward or downward deflection of control surfaces 154, 156 and result in a change in pitch attitude of the model airplane. By deflecting control stick 182 to the left or right, switches 190, 192 will be engaged. Such engagement will result in transmission of a signal from transmitter 180 to the receiver within the model airplane and decoded to energize coils 166, 172 and create magnetic fields of different polarity to cause control surfaces 154, 156 to deflect in opposite directions. Such movement of the control surfaces will result in a change in direction, left or right, of the model airplane. Accordingly, transmitter 180 provides the capability for 2-axis control of a model airplane. Such 2-axis control can be used with any of the model airplanes shown in FIG. 6, 9 or 10.

I claim:

1. A remotely controlled model airplane, said airplane comprising in combination:

a) a vertical stabilizer;

b) a rudder;

c) a flexible hinge for urging said rudder into alignment with said vertical stabilizer;

d) a coil mounted to said vertical stabilizer;

e) a magnet attached to said rudder proximate said coil;

f) a receiver responsive to a radio frequency signal for generating a control signal to energize said coil and create a magnetic field for urging repositioning of said magnet to deflect said rudder relative to said vertical stabilizer.

2. The remotely controlled airplane as set forth in claim 1, including a transmitter for generating a radio frequency signal and for transmitting the radio frequency signal to said receiver, said receiver including an antenna for receiving the radio frequency signal and a demodulator for demodulating said radio frequency signal to generate said control signal.

3. The remotely controlled airplane as set forth in claim 1 wherein said flexible hinge includes a pair of segments of rubber bands attaching said rudder with said vertical stabilizer.

4. The remotely controlled airplane as set forth in claim 3 wherein said coil is mounted on said vertical stabilizer intermediate said pair of segments.

5. The remotely controlled airplane as set forth in claim 4 wherein said magnet is mounted at the leading edge of said rudder and generally centered on said coil.

6. The remotely controlled airplane as set forth in claim 1, including a propeller and motor for providing forward thrust.

7. The remotely controlled airplane as set forth in claim 6 wherein said receiver includes means for generating a further control signal to vary the thrust provided by said propeller.

8. The remotely controlled airplane as set forth in claim 7, including a transmitter for generating a radio frequency signal and for transmitting the radio frequency signal to said receiver, said receiver including an antenna for sensing the radio frequency signal and a demodulator for demodulating said radio frequency signal to generate said control signal and said further control signal.

9. The remotely controlled airplane as set forth in claim 6 wherein said flexible hinge includes a pair of segments of rubber bands for attaching said rudder with said vertical stabilizer.

10. The remotely controlled airplane as set forth in claim 9 wherein said coil is mounted on said vertical stabilizer intermediate said pair of segments.

11. The remotely controlled airplane as set forth in claim 10 wherein said magnet is mounted at the leading edge of said rudder and generally centered on said coil.

12. A control apparatus for a model airplane having a longitudinal axis, said control apparatus comprising in combination:

a) a vertical stabilizer having a rudder pivotally attached with a flexible hinge, said flexible hinge urging planar alignment of said rudder with said vertical stabilizer;

b) an electrical coil mounted on said vertical stabilizer;

c) a magnet mounted on said rudder, said magnet being moveably responsive to energization of said coil to deflect said rudder relative to said vertical stabilizer; and d) a radio control transmitter for transmitting a signal to receiver to selectively energize said coil to control the direction of travel of said model airplane.

13. A control apparatus for a model airplane as set forth in claim 12 wherein said hinge comprises at least a pair of segments of rubber bands, each of said segments interconnecting said vertical stabilizer with said rudder.

14. A control apparatus for a model airplane as set forth in claim 13 wherein said magnet is attached to said rudder intermediate said pair of segments.

15. A control apparatus for a model airplane as set forth in claim 12 wherein said coil includes an axis of rotation and wherein said axis of rotation is essentially parallel with the longitudinal axis of said model airplane.

16. A control apparatus for a model airplane as set forth in claim 15 wherein said magnet includes a magnetic axis having a north pole and a south pole essentially aligned with said magnetic axis and wherein said magnetic axis is orthogonal to said axis of rotation when said coil is not energized.

17. A control apparatus for a model airplane as set forth in claim 16 wherein said coil includes a first state of energization to create a first magnetic field to attract the north pole of said magnet and cause deflection of said rudder in one direction and a second state of energization to create a second magnetic field to attract the south pole of said magnet and cause deflection of said rudder in the other direction.

18. A method for controlling the direction of flight of a model airplane, said method comprising the steps of:

a) a radio frequency transmitter and receiver for generating a control sign to energize an electrical coil mounted on the vertical stabilizer of the model airplane;

b) selectively energizing the coil with the transmitter and receiver to create a first or a second magnetic field;

c) deflecting the rudder of the model airplane attached to the vertical stabilizer with a magnet mounted on the rudder and pivotally responsive to each of the first and second magnetic fields created by the coil to deflect the rudder in one direction or the other; and d) urging the rudder to remain undeflected in the absence of a magnetic field with a hinge interconnecting the rudder with the vertical stabilizer.

19. The method as set forth in claim 18 wherein said step of urging is carried out by a pair of segments of rubber bands interconnecting the rudder with the vertical stabilizer.

20. A remotely controlled model airplane, said airplane comprising in combination:

a) a vertical stabilizer, a rudder, and a flexible hinge interconnecting said vertical stabilizer with said rudder for urging said rudder into alignment with said vertical stabilizer;

b) a coil mounted to said vertical stabilizer and a magnet mounted to said rudder proximate said coil;

c) a horizontal stabilizer, an elevator and a further flexible hinge interconnecting said horizontal stabilizer with said elevator for urging said elevator into alignment with said horizontal stabilizer;

d) a further coil mounted to said horizontal stabilizer and a further magnet mounted to said elevator proximate said further coil; and e) a receiver responsive to a radio frequency signal for selectively generating first and second control signals to energize said coil and said further coil and create magnetic fields for urging repositioning of said first and second magnets, respectively, and said further magnetic to deflect said rudder and said elevator relative to said vertical stabilizer and said horizontal stabilizer, respectively.

21. The remotely controlled airplane as set forth in claim 20, including a transmitter for selectively generating radio frequency signals and for transmitting the radio frequency signals to said receiver, said receiver including an antenna for receiving the radio frequency signals and a demodulator for selectively demodulating said radio frequency signals to generate said first and second control signals.

22. The remotely controlled airplane as set forth in claim 20 wherein each of said flexible hinge and said further flexible hinge includes a pair of segments of rubber bands attaching said rudder with said vertical stabilizer and a further pair of segments of rubber bands for attaching said elevator with said horizontal stabilizer, respectively.

23. The remotely controlled airplane as set forth in claim 22 wherein said coil is mounted on said vertical stabilizer intermediate said pair of segments and wherein said further coil is mounted on said horizontal stabilizer intermediate said pair of segments.

24. The remotely controlled airplane as set forth in claim 23 wherein said magnet is mounted at the leading edge of said rudder and generally centered on said coil and wherein said further magnet is mounted at the leading edge of said elevator generally centered on said further coil.

25. A remotely controlled model airplane having a V-tail, said airplane comprising in combination:

a) a first control surface, a first stabilizer of the V-tail and a flexible hinge interconnecting said first control surface with said first stabilizer for urging said first control surface into alignment with said first stabilizer;

b) a second control surface, a second stabilizer of the V-tail and a further flexible hinge interconnecting said second control surface with said second stabilizer for urging said second control surface into alignment with said second stabilizer;

c) a first coil mounted to said first stabilizer and a first magnet mounted to said first control surface proximate said first coil;

d) a second coil mounted on said second stabilizer and a second magnet mounted on said second control surface proximate said second coil; and e) a receiver responsive to a radio frequency signal for generating control signals to selectively energize said first and second coils and create magnetic fields for urging repositioning of said magnets to deflect said first and second control surfaces relative to said first and second stabilizers, respectively.

26. The remotely controlled airplane as set forth in claim 25, including a transmitter for selectively generating radio frequency signals and for transmitting the radio frequency signals to said receiver, said receiver including an antenna for receiving the radio frequency signals and a demodulator for selectively demodulating said radio frequency signals to generate said control signals.

27. The remotely controlled airplane as set forth in claim 25 wherein each of said flexible hinge and said further flexible hinge includes a pair of segments of rubber bands attaching said first control surface with said first stabilizer and a further pair of segments of rubber bands for attaching said second control surface with said second stabilizer.

28. The remotely controlled airplane as set forth in claim 27 wherein said first and second coils are mounted on said first and second stabilizers, respectively, intermediate said corresponding pair of segments.

29. The remotely controlled airplane as set forth in claim 28 wherein said first and second magnets are mounted at the leading edge of said first and second control surfaces, respectively, generally centered on said first and second coils, respectively.

30. A remotely controlled flying wing model airplane, said airplane comprising in combination:

a) a first elevon and a second elevon for controlling movement of said airplane about its longitudinal axis and its pitch axis;

b) a first flexible hinge interconnecting said first elevon with said airplane for urging said first elevon into alignment with said flying wing;

c) a second flexible hinge interconnecting said second elevon with said airplane for urging said second elevon into alignment with said flying wing;

d) a first coil mounted to said flying wing and a first magnet mounted to said first elevon proximate said first coil;

e) a second coil mounted to said flying wing and a second magnet mounted to said second elevon proximate said second coil; and f) a receiver responsive to a radio frequency signal for selectively generating first and second control signals to energize said first coil and said second coil and create magnetic fields for urging repositioning of said first magnet and said second magnet to deflect said first elevon and said second elevon, respectively, relative to said flying wing.

31. The remotely controlled airplane as set forth in claim 30, including a transmitter for selectively generating radio frequency signals and for transmitting the radio frequency signals to said receiver, said receiver including an antenna for receiving the radio frequency signals and a demodulator for selectively demodulating said radio frequency signals to generate said first and second control signals.

32. The remotely controlled airplane as set forth in claim 30 wherein each of said first flexible hinge and said second flexible hinge includes a first pair of segments of rubber bands for attaching said first elevon with said flying wing and a second pair of segments of rubber bands for attaching said second elevon with said flying wing.

33. The remotely controlled airplane as set forth in claim 32 wherein said first and second coils are mounted on said flying wing intermediate said first and second pair of segments, respectively.

34. The remotely controlled airplane as set forth in claim 33 wherein said first and second magnets are mounted at the leading edge of said first and second elevons generally centered on said first and second coils, respectively.

* * * * *